United States Patent [19]

Cardono

[11] 4,234,174

[45] Nov. 18, 1980

[54] APPARATUS FOR AIDING THE CUTTING OF A RUBBER MOLD

[76] Inventor: Angelo Cardono, 11114 New St., Downey, Calif. 90241

[21] Appl. No.: 36,775

[22] Filed: May 7, 1979

[51] Int. Cl.[3] ..... B25B 1/20

[52] U.S. Cl. ..... 269/37; 269/60; 269/152; 269/157; 269/239; 269/909

[58] Field of Search ..... 269/37, 60, 104, 152, 269/157, 239, 321 W; 254/51, 54, 67; 12/111

[56] References Cited

U.S. PATENT DOCUMENTS

| | | | |
|---|---|---|---|
| 289,861 | 12/1883 | Schrepel | 269/239 |
| 1,120,798 | 12/1914 | Duecker | 254/67 |
| 1,515,286 | 11/1924 | Suebilius | 269/239 |
| 1,697,117 | 1/1929 | Hilstad et al. | 269/104 |

*Primary Examiner*—Robert C. Watson
*Attorney, Agent, or Firm*—Dominick Nardelli

[57] ABSTRACT

The apparatus has a pair of spaced arms hinged at their lower ends to a base. The upper end of each arm supports a jaw which is used to grip the rubber mold. Each arm has a nut pivotably supported between the ends thereof which nut pivots about an axis parallel to the base and perpendicular to the centerline of the nut so that a long bolt, which is threaded in the nut and has its end pivotably anchored to the base, can rigidly support the arms in a substantially upright and variable position. Then by simply rotating each long bolt, the respective arm is made to rotate to change its angle it makes with the vertical.

2 Claims, 3 Drawing Figures

APPARATUS FOR AIDING THE CUTTING OF A RUBBER MOLD

FIELD OF THE INVENTION

This invention relates to an apparatus for supporting a work piece to be worked on and, more particularly, to a flexible rubber-like mold which is to be used to cast jewelry.

BACKGROUND OF THE INVENTION

When intricate items, such as jewelry, have to be duplicated in mass production, the pattern or model is enclosed in a rubber-like plastic mold which is very resilient and strong. Then to remove the model which is imbedded in the mold, formed around the model, the mold has to be split preferably into two sections which are left joined together along one edge so that the two sections can be replaced alongside each other to reform the cavity which the model occupied. Now the cavity may be filled with a "wax" which, when hardened, takes the shape of the cavity. The wax formed is removed to be used in forming a ceramic mold so that the metallic jewelry can be cast using the well known "lost wax casting process." Since the rubber mold is very soft and resilient up to now one found it very difficult to anchor this mold when one attempts to split it with a sharp knife.

OBJECTS OF THE INVENTION

An object of this invention is to provide a simple, economical apparatus for supporting a rubber mold which one is attempting to split to remove the model.

Another object of this invention is to provide an apparatus for keeping the rubber mold taut or tight as one attempts to split it to remove the model.

These and other objects and features of advantage will become more apparent after one studies the following description of the preferred embodiment of my invention, together with the appended drawing.

DETAILED DESCRIPTION OF THE DRAWING

Figure 1:
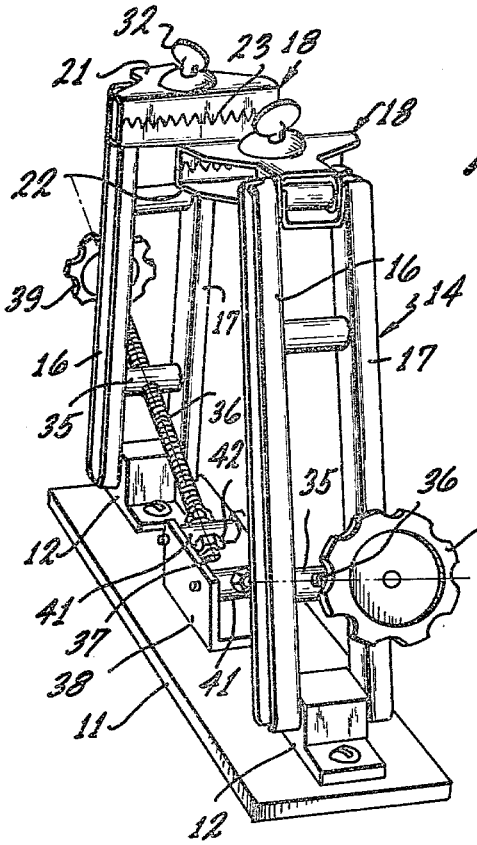
FIG. 1 is a pictorial view of my novel apparatus shown in the upright position with the front shown to the left and the right side shown on the right.
Figure 3:
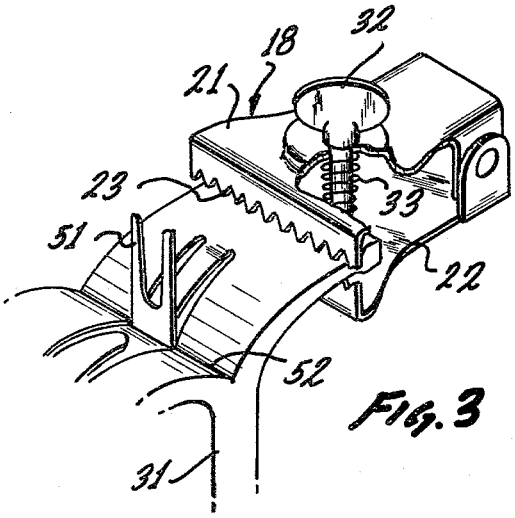
FIG. 3 is an enlarged pictorial of one of the jaws shown gripping the rubber mold.
Figure 2:
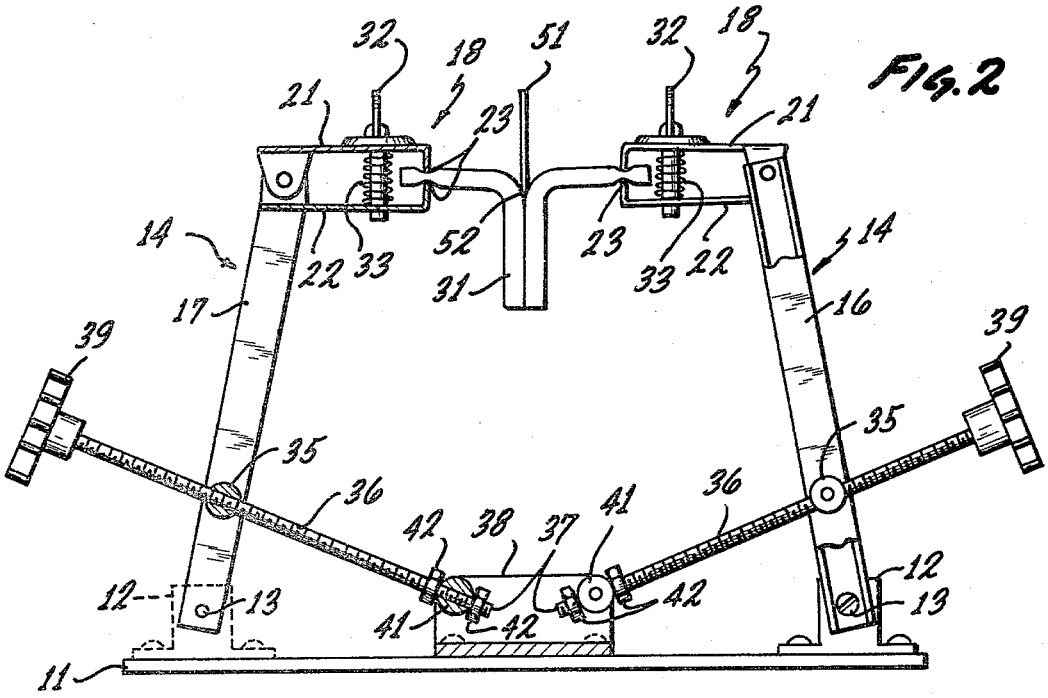
FIG. 2 is a front elevation of the apparatus shown in FIG. 1, with portions thereof broken away to more clearly show the details.

Since my apparatus is portable, I have provided a base 11 made of a relatively heavy material so that the apparatus may not tip easily. On the base 11 are two spaced apart blocks 12 wherein, in FIG. 2, the left block is shown in phantom by dash lines, for obvious reasons. The blocks 12 have horizontal bores which are parallel to each other, and each of which take a pin 13. To each pin are coupled arms 14, each of which are preferably made of two channel members 16 and 17. Between and on the ends of the channel members 16 and 17 on each arm 14 is pivotably coupled a jaw 18 by pin 19. The jaws 18 are made of two sheet metal parts 21 and 22, bent to the shape as shown and having teeth 23 along one edge. The teeth 23 on each jaw 18 face each other so that the rubber mold or workpiece 31 can be gripped therebetween, as shown. The jaws 18 have suitable thumb screws 32 and compression springs 33 to cause the teeth to grip the mold and to cause the two parts 21 and 22 to spread as the thumb screws are turned.

To hold the mold 31 taut or tight in the lateral direction, each arm 14 is provided with a suitable nut 35 which is preferably barrel-shaped, with the threads disposed perpendicular to the axis of the barrel. The nuts 35 are suitably disposed between the respective channels 16 and 17 so that they pivot about a horizontal axis which is coaxial with the barrel axis. Long bolts 36 are threaded into nuts 35 and have their lower ends 37 anchored in a U-shaped member means 38. In order to allow bolts 36 to be rotated when handles 39 are rotated, the ends 37 loosely fit into a transverse bore formed in a short cylinder 41, which, in turn, is mounted in member 38 to pivot also about a horizontal axis. On each side of cylinder 41 are disposed stops 42 which are fixed to bolts 36, in order to prevent axial motion of the bolts with respect to the cylinders 41. Now as one rotates the handles 39 the respective arms 14 are made to pivot through a vertical angle. When the handles 39 are not rotated, the position of the respective arms are fixed and locked. Now as one is attempting to remove the model 51 by cutting at line 52, the mold inherently becomes slack. The mold can readily and easily be made taut again by rotating handles 39 in the direction to cause the respective arms to pivot towards the vertical from the position as shown in the drawing.

Having described the preferred embodiment of my invention, one skilled in the art, after studying this preferred embodiment, could devise other embodiments without departing from the scope of my invention. Therefore, my invention is not to be considered limited to the embodiment described, but includes all embodiments falling within the scope of the appended claims.

I claim:

1. An apparatus for working on a workpiece comprised of:

a base;

a pair of arms;

a pair of blocks mounted on said base in spaced apart relationship;

each of said blocks having a bore and said bores are disposed parallel to each other;

each of said arms comprising of two spaced-apart parallel channels;

one of said blocks being disposed between said two spaced apart channels of a respective one of said arms;

a pin disposed through each one of said bores in said blocks and through said two spaced apart channels of said respective one of said arms so that said arms rotate with respect to said base and substantially in the same plane;

a jaw being pivotably mounted between the channels of each respective one of said arms;

a nut member rotatably mounted between the channels of a respective one of said arms and between said block and said jaw;

said nut member having a threaded hole formed therein disposed at right angles to the axis of rotation of said nut member;

a long bolt threaded through a respective one of said nut member;

anchor means disposed between said blocks for engaging one end of said long bolt so that said bolt is fixed axially and is capable of rotating about its own axis and on another axis, parallel to said pins and disposed passing through said anchor means.

2. The apparatus of claim 1 wherein:

said anchor means comprises:

a U-shaped member mounted on said base and between said blocks;

a pair of cylindrical members mounted within said U-shaped member so that they rotate about a respective axis parallel to said pins;

each of said cylindrical members having an opening disposed at right angles to its axis of rotation;

said long bolts having their ends slidably passing through a respective one of said openings;

a pair of stops fixed onto each one of said bolts and disposed on each side of said cylindrical member.

* * * * *